US006672497B2

(12) United States Patent
Lin

(10) Patent No.: US 6,672,497 B2
(45) Date of Patent: Jan. 6, 2004

(54) POWER STAPLER

(76) Inventor: Wang-Kuan Lin, 11F-2, No. 43, Chai-I Street, Taichung (TW)

( * ) Notice: Subject to any disclaimer, the term of this patent is extended or adjusted under 35 U.S.C. 154(b) by 0 days.

(21) Appl. No.: 10/105,727

(22) Filed: Mar. 25, 2002

(65) Prior Publication Data

US 2002/0100787 A1 Aug. 1, 2002

Related U.S. Application Data

(62) Division of application No. 09/617,824, filed on Jul. 17, 2000, now Pat. No. 6,454,151.

(51) Int. Cl.[7] ..... B25C 1/04

(52) U.S. Cl. ..... 227/8; 227/120; 227/130

(58) Field of Search ..... 227/120, 8, 130, 227/140, 136, 151, 154

(56) References Cited

U.S. PATENT DOCUMENTS

| | | | | | |
|---|---|---|---|---|---|
| 3,253,760 | A | * | 5/1966 | Doyle et al. | 227/130 |
| 3,258,835 | A | * | 7/1966 | Boggild et al. | 227/130 |
| 4,688,710 | A | * | 8/1987 | Massari, Jr. et al. | 227/8 |
| 5,628,445 | A | * | 5/1997 | Braddock et al. | 227/140 |
| 5,873,510 | A | * | 2/1999 | Hirai et al. | 227/8 |
| 6,059,167 | A | * | 5/2000 | Ho et al. | 227/130 |

* cited by examiner

*Primary Examiner*—Scott A. Smith
(74) *Attorney, Agent, or Firm*—Charles E. Baxley

(57) ABSTRACT

A power stapler includes a body with a barrel and a handle is connected to the body by a connection plate. The handle has an open bottom end and an end member is engaged with the open bottom end. A connection portion extends from the handle and a magazine is connected between the connection portion and the barrel. The connection portion has a groove for receiving an L-shaped wrench. A safety device is connected to the barrel and has a link which contacts the trigger device.

3 Claims, 9 Drawing Sheets

PIROR ART

POWER STAPLER

FIELD OF THE INVENTION

This application is a Divisional Application for applicant's former application U.S. Ser. No. 09/617,824, with a title of "Power Stapler" filed on Jul. 17, 2000 now U.S. Pat. No. 6,454,151.

BACKGROUND OF THE INVENTION

A conventional power stapler is shown in FIG. 1 and generally includes a body 10 with a barrel 100 extending from the body 10. A safety device 13 is received in the barrel 100 and is able to actuate a trigger means 11 to a ready-for-shoot status. A handle 101 is integrally connected to the body 10 and has a passage 102 defined therein. A magazine 14 is connected between the handle 101 and the barrel 100 so as to receive nails therein. A fitting of a hose 17 is connected to the handle 101 so that pressurized air is sent into the passage 102 in the handle 101 to eject a nail in the magazine 14. The body 10 and the handle 101 are made of cast iron so that it is so heavy and is not convenient to be used. When nailing nails into an object, the nose piece is pushed against the object so as to put the trigger means 11 to a ready status. Because the power stapler is heavy in weight and only one point contacts against the object so that it is difficult to nail the object at even distance. Furthermore, the safety device 13 is not adjustable so that the conventional power stapler can only use a fix-sized nails.

The present invention intends to provide a power stapler which has a separated handle made of light material and an adjustable nose piece so as to adjust a distance that a line of the safety device can be moved to touch a trigger means.

SUMMARY OF THE INVENTION

In accordance with one aspect of the present invention, there is provided a power stapler and comprising a body with a barrel and a trigger means. A handle is connected to the body by bolt and a magazine is connected between the handle and the barrel. A safety device is connected to the barrel and includes a link connected to the trigger means.

The primary object of the present invention is to provide a power stapler which has a handle light in weight. The handle is connected to the body by a connection plate and bolts.

Another object of the present invention is to provide a power stapler which has an end member connected to the handle by a pin and an L-shaped wrench is received in a connection portion extending from the handle.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 8:
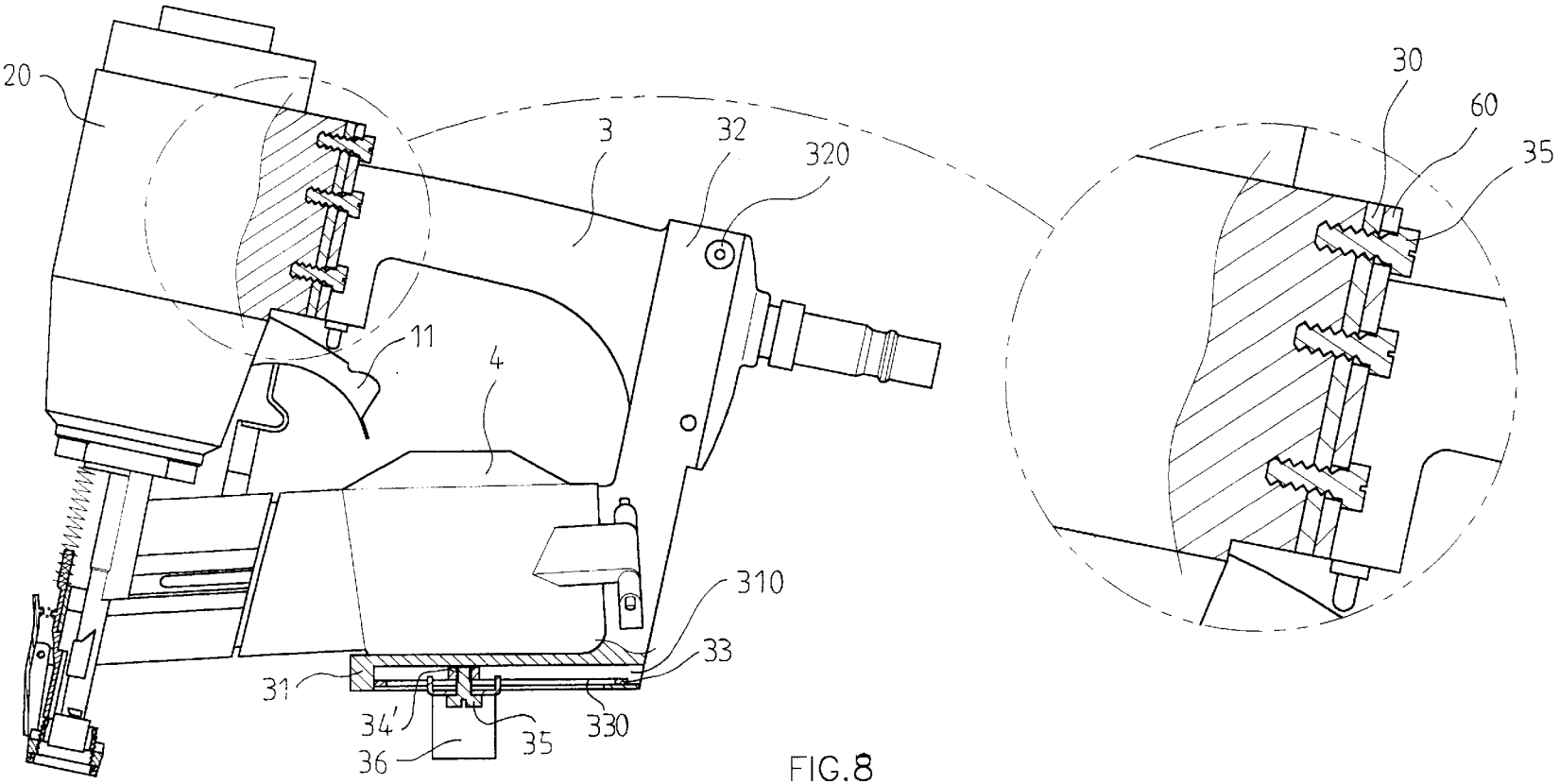
FIG. 8 is a cross sectional view to show the connection between a body and a handle of the power stapler of the present invention.
Figure 9:
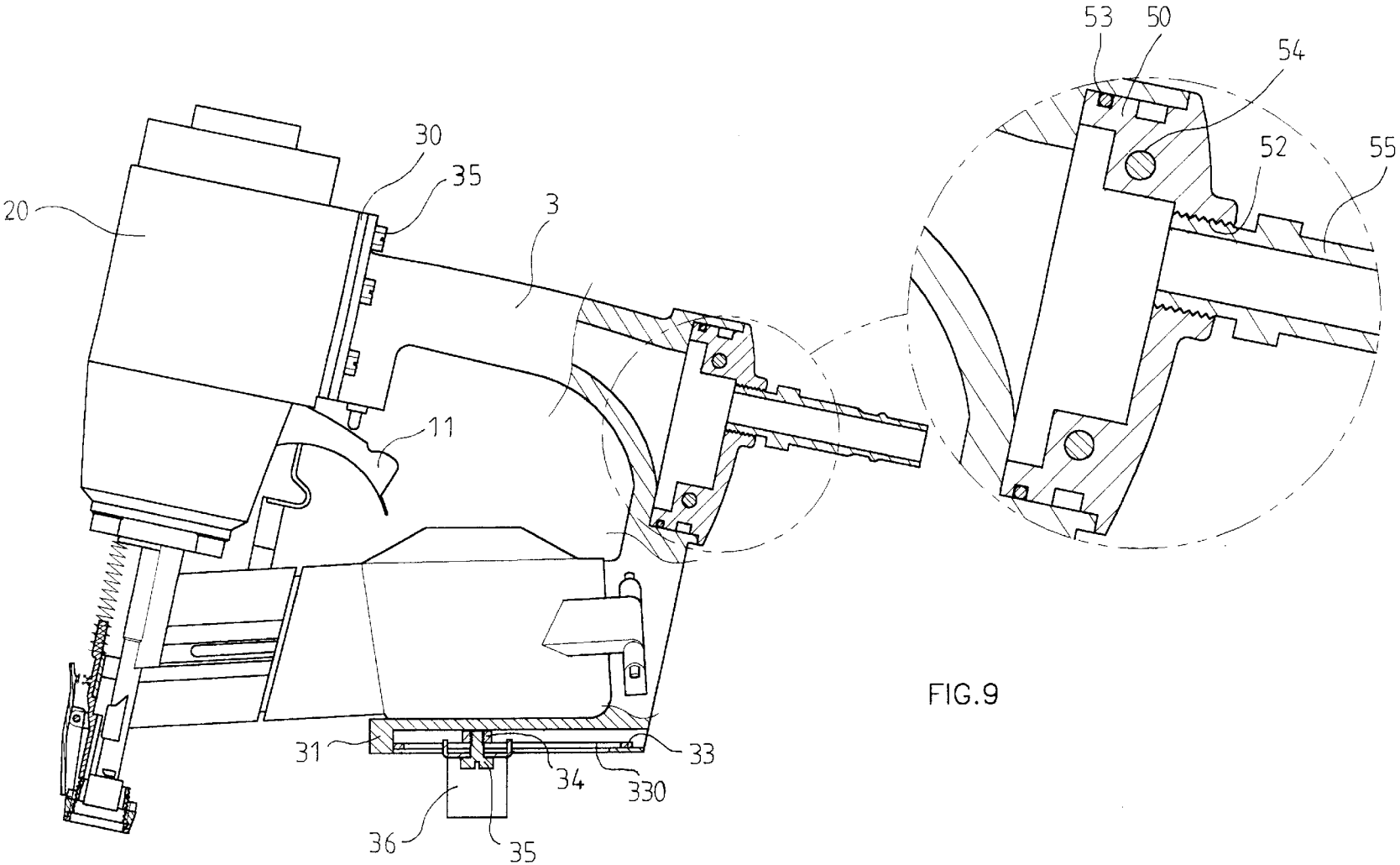
FIG. 9 is a cross sectional view to show the connection between the handle and an end member of the power stapler of the present invention.
Figure 10:
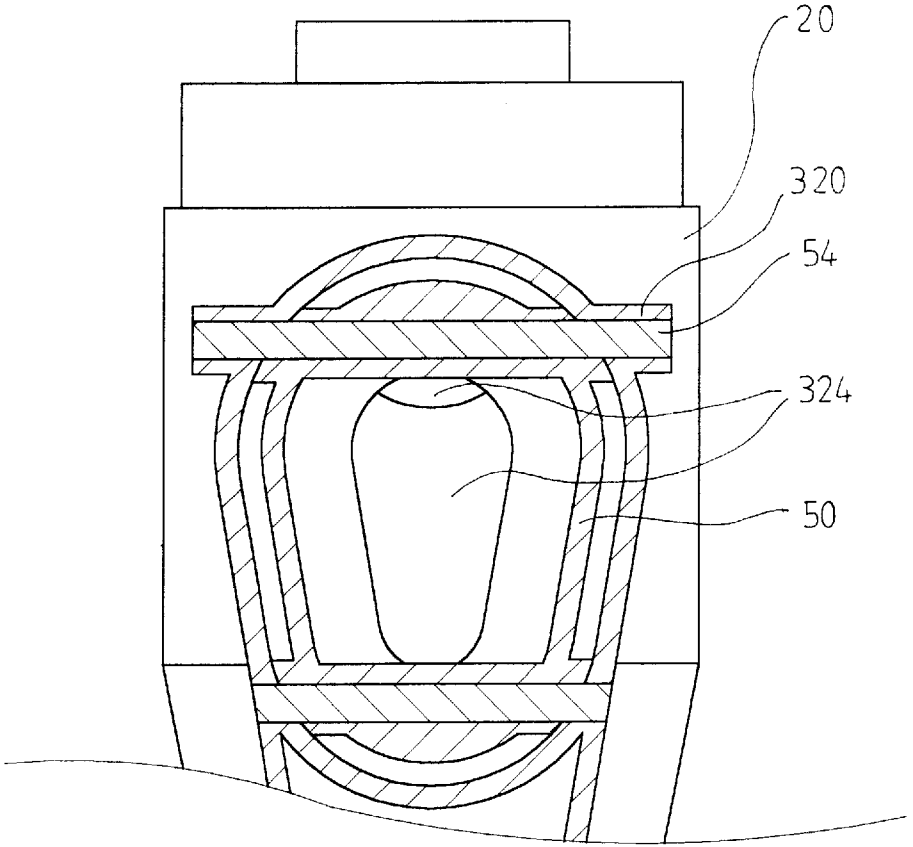
FIG. 10 is a cross sectional view to show a pin connecting the end member to the handle of the power stapler of the present invention.

Referring to FIGS. 1, 2, 4 and 8, the power stapler of the present invention comprises a body 20 with a barrel 21 extending therefrom and a trigger means 11 is connected to the body 20. A safety device 7 is connected to the barrel 21 and has a link 70 which contacts the trigger means 11. A plurality of threaded holes 201 are defined in an underside of the body 20. A handle 3 has flange 30 extending radially from a top end thereof and a plurality of first holes 301 are defined through the flange 30. A U-shaped connection plate 60 is mounted to the handle 3 and has a plurality of second holes 601 defined therethrough. The handle 3 is fixedly connected to the body 20 by extending bolts 35 through the second holes 601, the first holes 301 and engaged with the threaded holes 201 as shown in FIG. 8. The connection plate 60 is made of highly structured material and the handle 3 can be made by light material so as to reduce total weight of the stapler. The handle 3 is connected to the body 20 and an open end 323 is defined in a bottom of the handle 3. A passage 324 defined longitudinally in the handle 3 and two tubes 320 extend radially from the handle 3. Each of the tube 320 has a first positioning hole 321 defined therethrough and the first positioning holes 321 communicate with the passage 324. An end member 5 has a skirt portion 50 which is inserted in the open end 323 and a seal 53 is mounted to the skirt portion 50. Two second positioning holes 51 are defined through the skirt portion 50 and a pin 54 extends through the first positioning holes 321 and the second positioning holes 51 to connect the end member 5 to the handle 3 as shown in FIGS. 9 and 10. A threaded hole 52 (FIG. 9) is defined through the end member 5 so as to be connected with a hose 55 such that pressurized air can be sent into the passage 324 via the hose 55.

Figure 1:
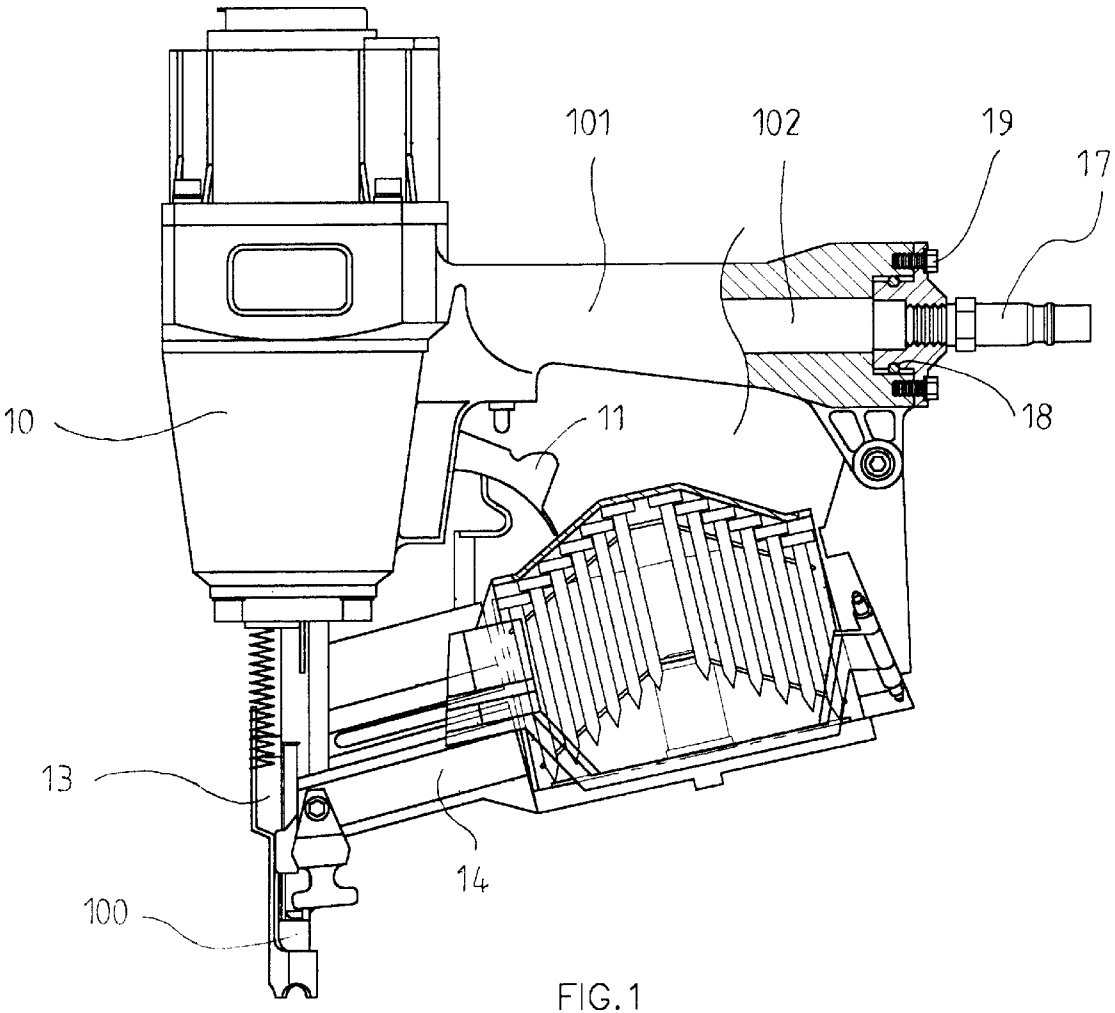
FIG. 1 is a cross sectional view to show a conventional power stapler.
Figure 2:
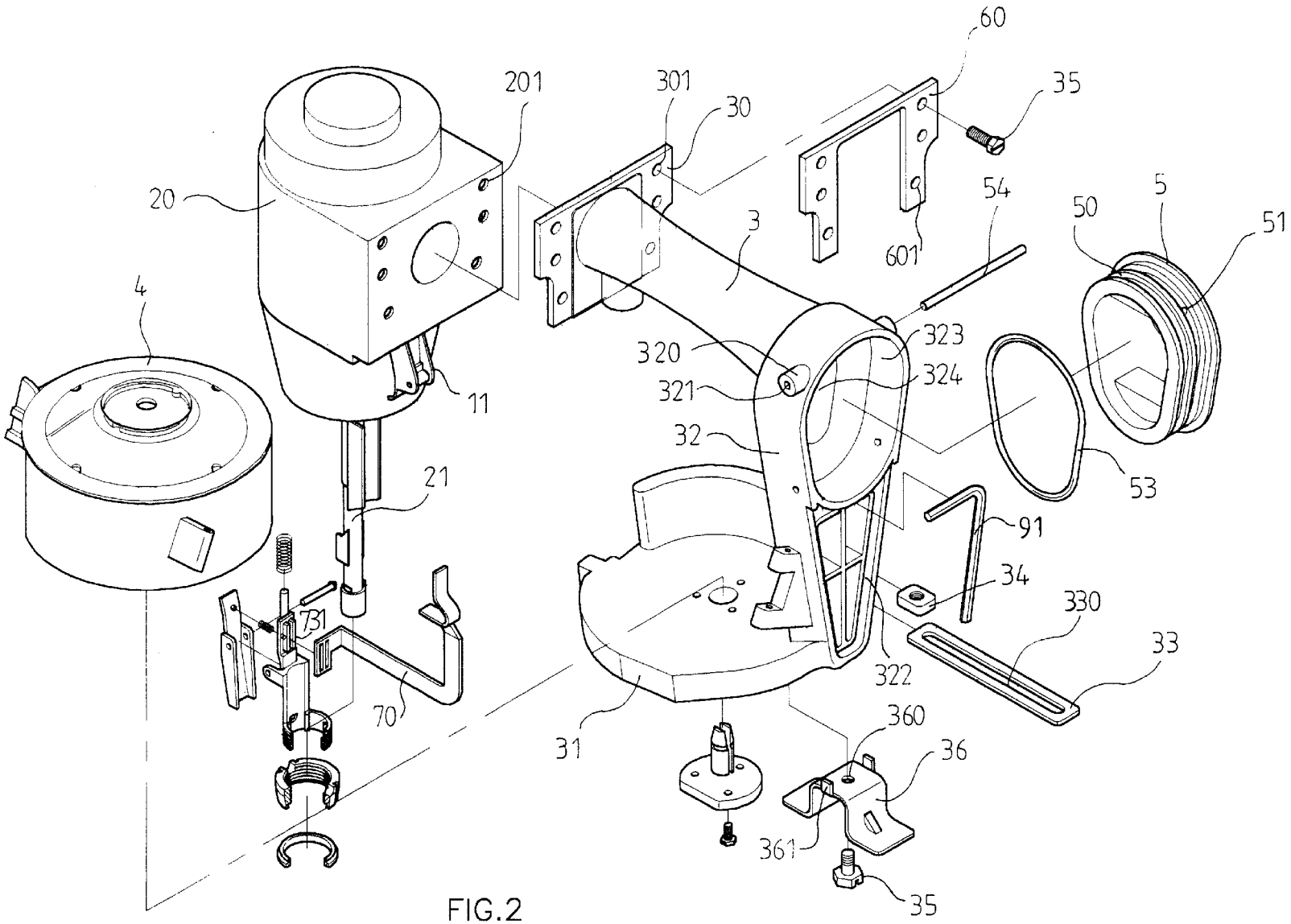
FIG. 2 is an exploded view to show a power stapler of the present invention.
Figure 3:
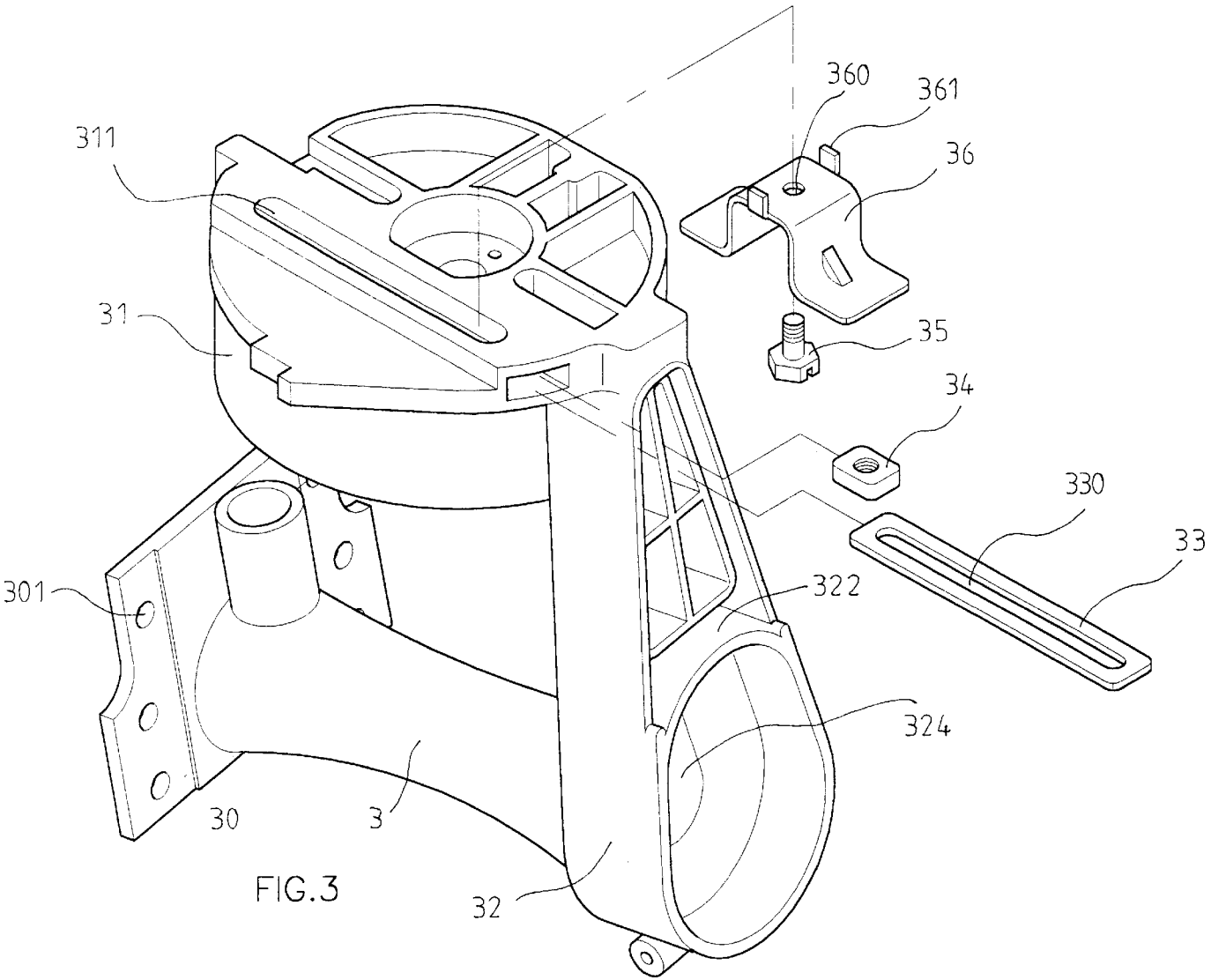
FIG. 3 is an exploded view to show a guide member and a fixing plate to be connected to the magazine frame of the present invention.
Figure 4:
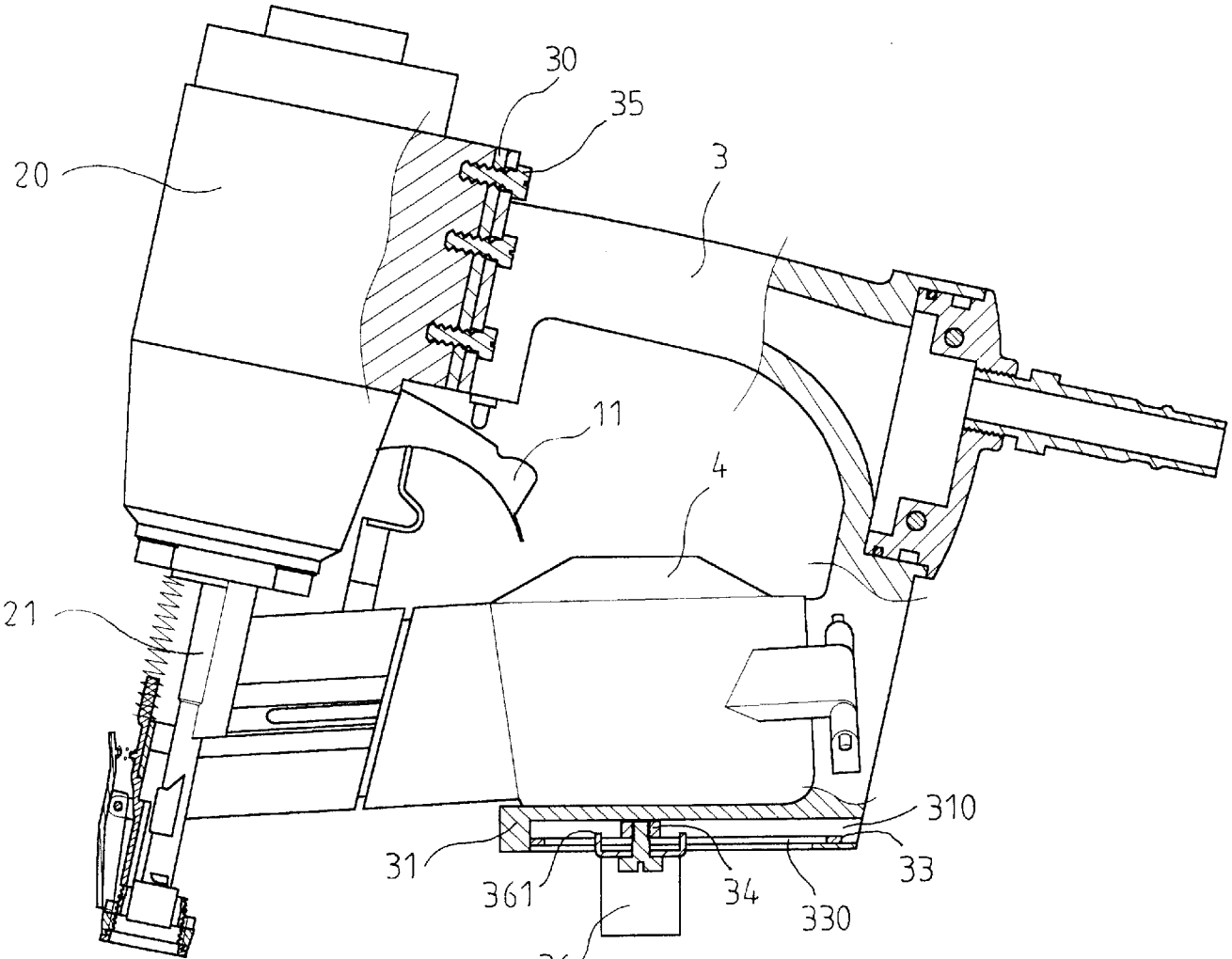
FIG. 4 is a cross sectional view to show the power stapler of the present invention.
Figure 5:
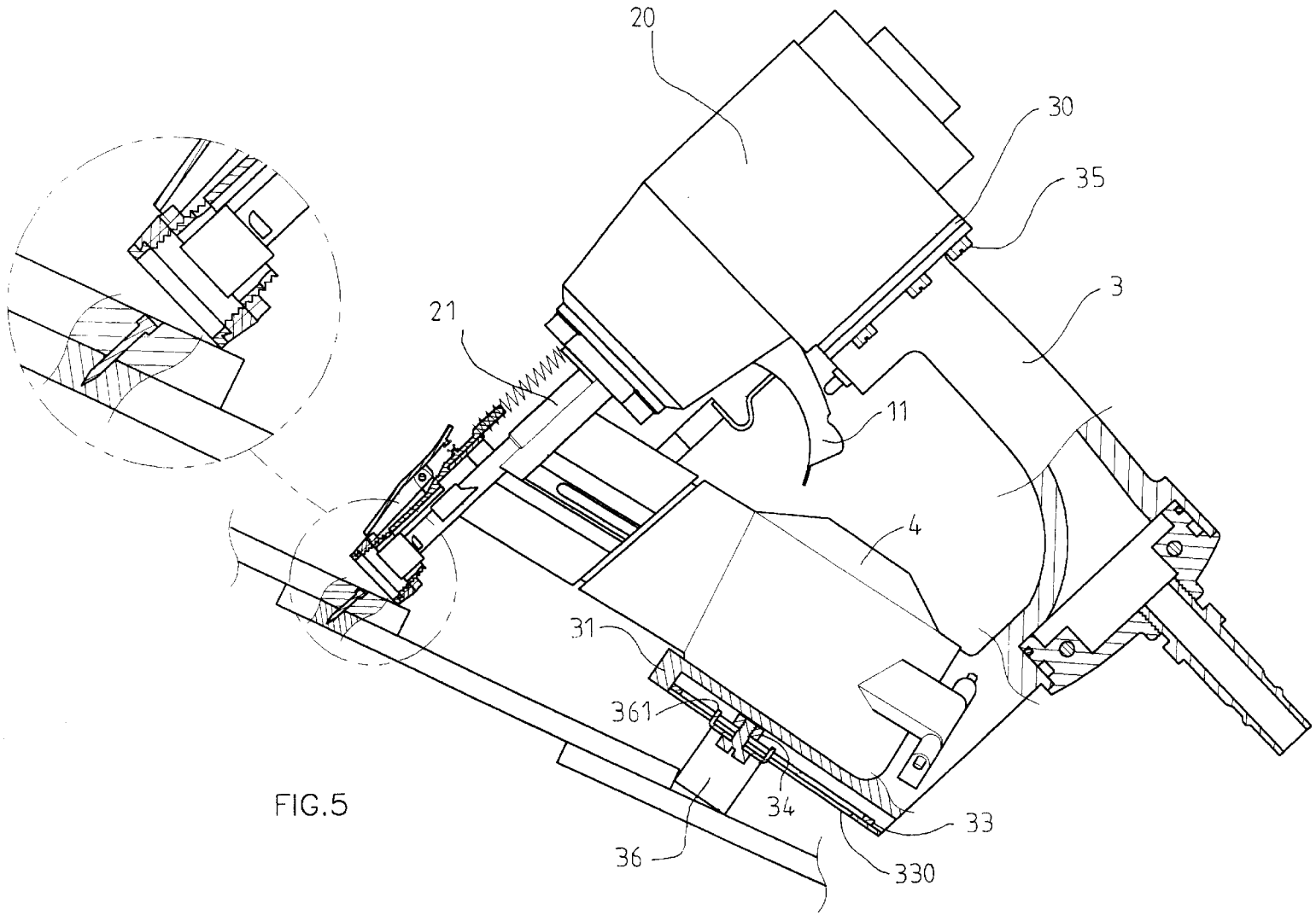
FIG. 5 is an illustrative view to show how the guide member is used to position the power stapler of the present invention.
Figure 6:
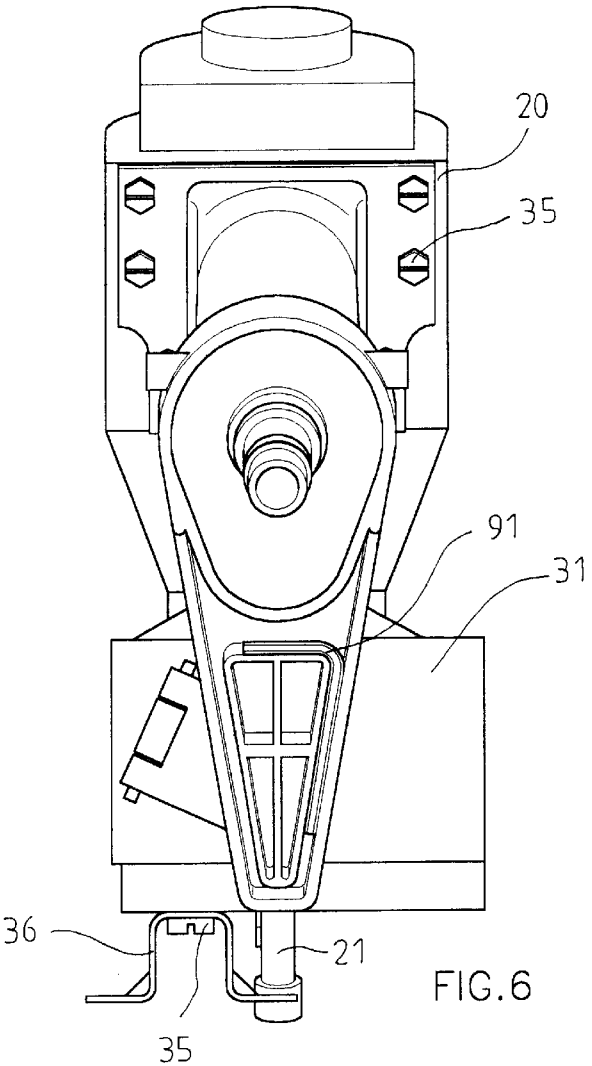
FIG. 6 is a bottom view to show the guide member on the power stapler of the present invention.
Figure 7:
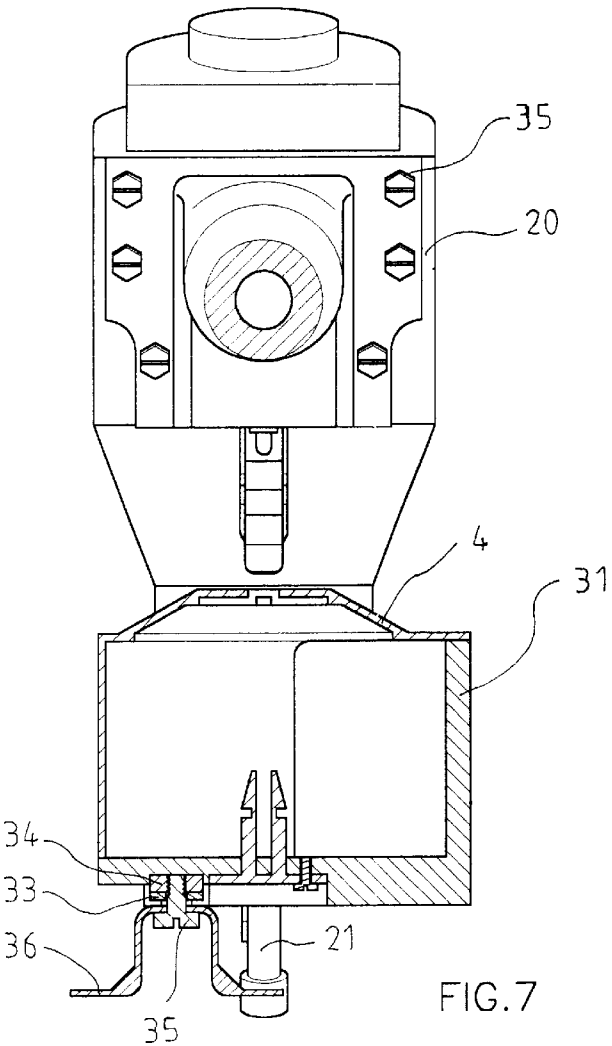
FIG. 7 is a cross section viewed from the bottom to show the guide member on the power stapler of the present invention.

Further referring to FIG. 3, a connection portion 32 extends from the handle 3 and a groove 322 is defined in an bottom of the connection portion 32 so that an L-shaped wrench 91 is received in the groove 322. The L-shaped wrench 91 is used to disassemble parts of the power stapler and occupies a very limited space.

A magazine frame 31 extends from the connection portion 32 and has a passage 310 defined therein. A magazine 4 is connected between the magazine frame 31 and the barrel 21. A fixing plate 33 is received in the passage 310 and has a first slot 330 defined longitudinally therethrough. A second slot 311 is defined through the magazine frame 31 and communicates with the second slot 311. Referring to FIGS. 3 to 7, a U-shaped guide member 36 has a flat portion with two wings extending from the flat portion, a bolt 35 extending through a hole 360 in the flat portion of the guide member 36, the second slot 311 and the first slot 330 and being engaged with a nut 34. Two insertions 361 extend from the flat portion of the guide plate 36 and the two insertions 361 are engaged with a periphery defining the second slot 311 when threading the bolt 35. Therefore, when loosening the bolt 35, the guide member 36 can be moved along the second slot 311.

While we have shown and described various embodiments in accordance with the present invention, it should be clear to those skilled in the art that further embodiments may be made without departing from the scope and spirit of the present invention.

What is claimed is:

1. A power stapler comprising:

a body with a barrel extending therefrom, a plurality of threaded holes defined in an underside of said body, a trigger means connected to said body;

a safety device connected to said barrel and having a link which contacts said trigger means;

a handle having flange extending radially from a top end thereof and a plurality of first holes defined through said flange, a connection plate mounted to said handle and having a plurality of second holes defined therethrough, bolts extending through said second holes, said first holes and engaged with said threaded holes to connect said handle to said body, a magazine frame extending from said handle, said magazine frame having a passage and a fixing plate received in said passage, said fixing plate having a first slot, a second slot defined through said magazine frame and communicating with said second slot, a guide member movably connected to an outside of said magazine frame, said guide member having a flat portion with two wings extending from said flat portion, a bolt extending through said flat portion of said guide member, said second slot and said first slot and engaged with a nut, and a magazine connected between said handle and said barrel.

2. The power stapler as claimed in claim 1 further comprising two insertions extending from said flat portion of said guide plate, said two insertions engaged with a periphery defining said second slot.

3. The power stapler as claimed in claim 1 further comprising a connection portion connected between said handle and said magazine frame, a groove defined in a bottom of said connection portion and an L-shaped wrench received in said groove.

* * * * *